United States Patent [19]

Savoy

[11] Patent Number: 5,022,528

[45] Date of Patent: Jun. 11, 1991

[54] BAGS FOR STORING ELECTRONIC RECORDING DEVICES AND LIQUID CONTAINERS

[75] Inventor: Steven Savoy, North Andover, Mass.

[73] Assignee: Posso Corporation, Kerrville, Tex.

[21] Appl. No.: 508,846

[22] Filed: Apr. 12, 1990

[51] Int. Cl.[5] ..... A45C 11/20; A45C 13/26

[52] U.S. Cl. ..... 206/545; 206/387; 150/108; 150/113; 150/117; 150/111

[58] Field of Search ..... 206/545, 387; 150/113, 150/117, 111, 107, 108

[56] References Cited

U.S. PATENT DOCUMENTS

| | | | |
|---|---|---|---|
| 2,827,096 | 3/1958 | Hinson | 150/117 X |
| 2,960,137 | 11/1960 | Lipsitz | 150/108 X |
| 4,537,313 | 8/1985 | Workman | 206/545 |
| 4,545,414 | 10/1985 | Baum | 150/113 X |
| 4,569,082 | 2/1986 | Ainsworth et al. | 150/113 X |
| 4,648,512 | 3/1987 | Tarozzi et al. | 206/545 X |
| 4,673,070 | 6/1987 | Ambal | 150/113 X |
| 4,836,343 | 6/1989 | Arney | 150/113 X |
| 4,925,027 | 5/1990 | Roze | 206/387 |

*Primary Examiner*—William I. Price
*Attorney, Agent, or Firm*—Fish & Richardson

[57] ABSTRACT

A bag for separately storing electronic recording devices (usually in their boxes) and liquid containers. The bag is provided with an insulated box, for storing the liquid containers, formed from a first base, four insulated walls, extending from and fixedly connected to the base, and a first flap pivotally fixed to one end of an insulated wall distant from the first base. The insulated walls are formed of insulating material having a waterproof inner surface. The flap in a first position is adapted to provide access to the box for insertion and removal of the liquid containers; and in a second position is adapted to prevent the liquid containers from falling from the insulated box. The insulated box is fixed to a storage case adapted for storing the electronic recording devices. The storage case is formed from a second base, four walls extending from and fixedly connected to the second base, and a second flap pivotally fixed to one wall distant from the second base. The second flap in a first position is adapted to provide access to the storage case for insertion and removal of the electronic recording devices; and in a second position is adapted to prevent the electronic recording devices from falling from the case. The case further includes separators for separately snugly engaging the electronic recording devices within the case, and allowing their easy insertion into and removal from the case.

9 Claims, 5 Drawing Sheets

BAGS FOR STORING ELECTRONIC RECORDING DEVICES AND LIQUID CONTAINERS

This invention relates to baqs for storage of a plurality of electronic recording devices, and a plurality of liquid containers.

The invention features a bag for separately storing electronic recording devices (usually in their boxes) and liquid containers. The bag is provided with an insulated box, for storing the liquid containers, formed from a first base, four insulated walls, extending from and fixedly connected to the base, and a first flap pivotally fixed to one end of an insulated wall distant from the first base. The insulated walls are formed of insulating material having a waterproof inner surface. The flap in a first position is adapted to provide access to the box for insertion and removal of the liquid containers; and in a second position is adapted to prevent the liquid containers from falling from the insulated box. The insulated box is fixed to a storage case adapted for storing the electronic recording devices. The storage case is formed from a second base, four walls extending from and fixedly connected to the second base, and a second flap pivotally fixed to one wall distant from the second base. The second flap in a first position is adapted to provide access to the storage case for insertion and removal of the electronic recording devices; and in a second position is adapted to prevent the electronic recording devices from falling from the case. The case further includes separators for separately snugly engaging the electronic recording devices within the case, and allowing their easy insertion into and removal from the case.

In preferred embodiments, the insulated box and storage case are removably fixed together, most preferably they are fixed together by a zipper; the insulated box and the storage case each have a separate strap to allow separate holding of the insulated box and storage case; the separators in the storage case are formed as a separate insert positioned within the storage case; the second flap is provided with a zipper to allow holding of the flap in the second position; two first flaps are provided and adapted to mate together to hold the liquid containers within the insulated box; a storage container is provided on one of the insulated walls formed from material extending from and fixed to that insulated wall, having an opening to allow insertion and removal of a player for an electronic recording device; and another insulated wall is provided with a pocket formed from rectangular-shaped material fixed along only three of its edges to the insulated wall.

This invention provides a bag, e.g., a shoulder bag, which is ideally suited for carrying and maintaining the desired temperature of cans or bottles of liquid refreshment, and separately for carrying electronic recording devices, e.g., audio tapes, video tapes, or compact discs in their containers. The insulated bag allows the liquid within the liquid containers to be kept cool by ice or other cooling materials within the container, without making the storage case wet. Preferably, the bag is adapted to allow complete separation of the insulated box from the storage case. Thus, the invention provides an ideal shoulder bag for picnics or the like where different items can be carried using a single shoulder strap, and those items later separated for easier use.

Other features and advantages of the invention will be apparent from the following description of the preferred embodiment, and from the claims.

The figures will first briefly be described.

Figure 1:
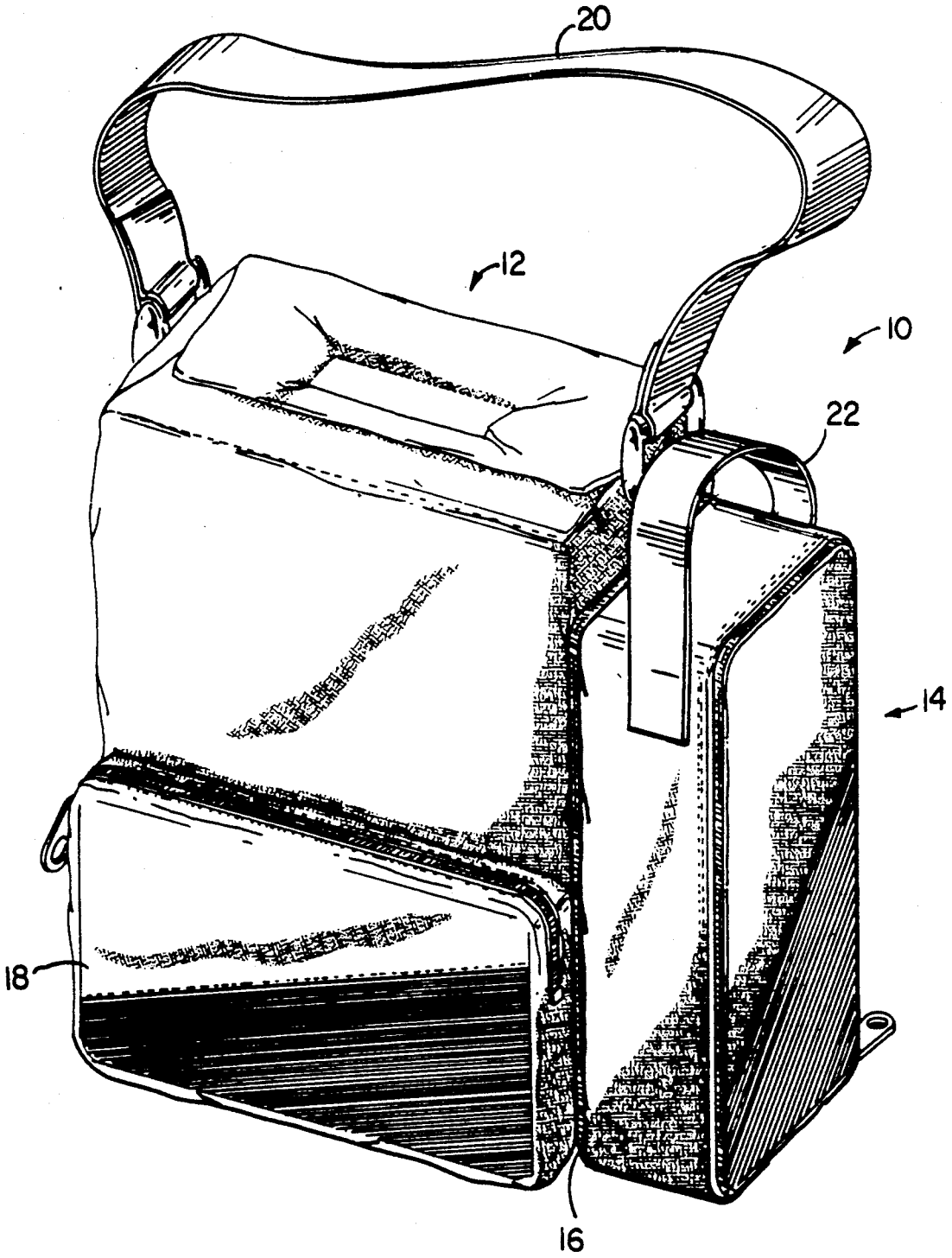
FIG. 1 is an isometric view of a shoulder bag.

Referring to the Figures, a shoulder bag 10 is formed from an insulated box 12 and a storage case 14 removably connected together by a zipper 16. Zipper 16 extends along the whole perimeter of the base of storage case 14. Also provided is a container 18 for holding a player for an electronic recording device, e.g., an audio tape player, on one of the walls of the insulated box. The insulated box is also provided with a shoulder strap 20; and the storage container 14 is provided with a hand strap 22.

Figure 2:
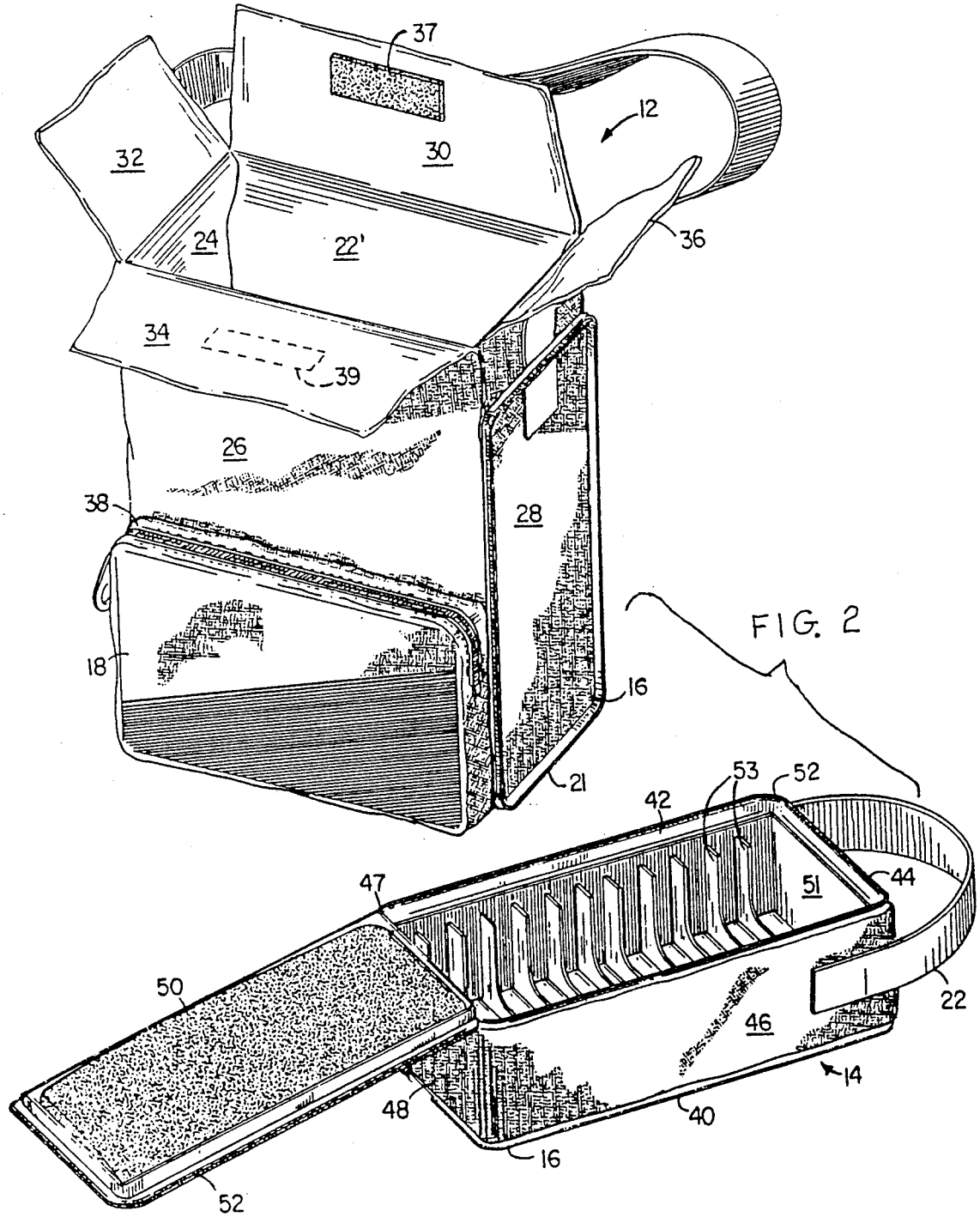
FIG. 2 is an isometric view of a shoulder bag with an insulated box and storage case separated from each other and opened.
Figure 4:
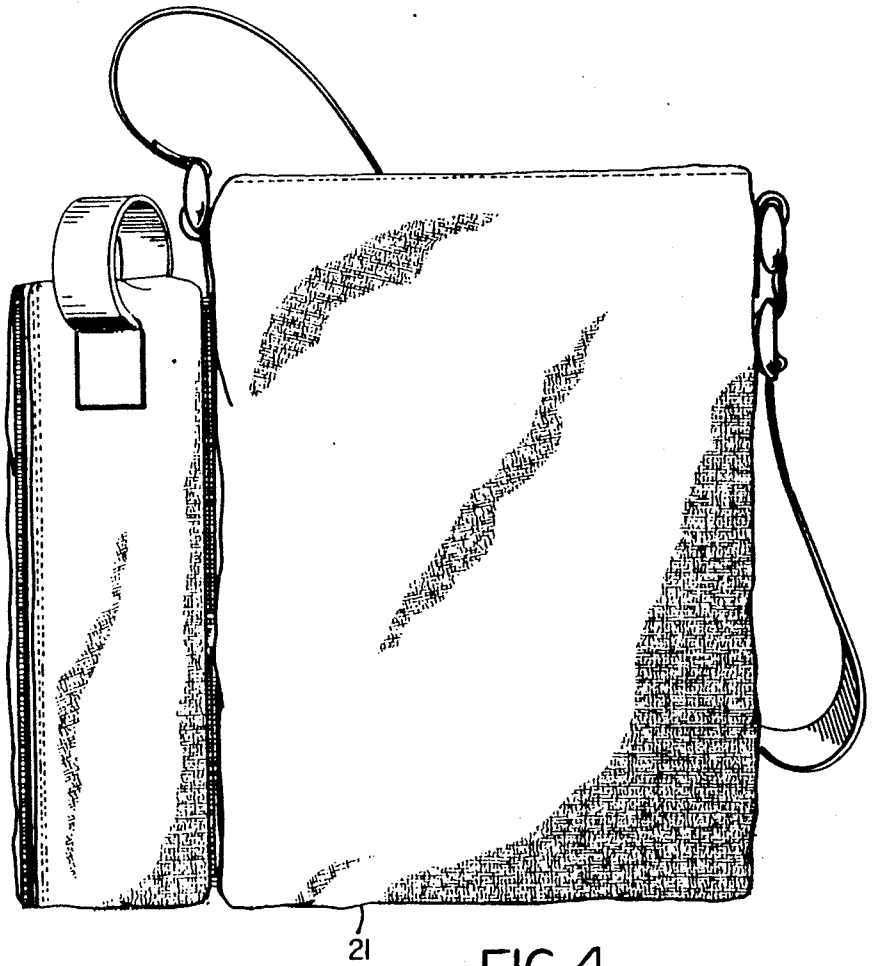
FIGS. 3, 4, 5, 6, 7, and 8 are isometric views respectively of the front, back, left side, right side, top, and bottom of a shoulder bag.
Figure 3:
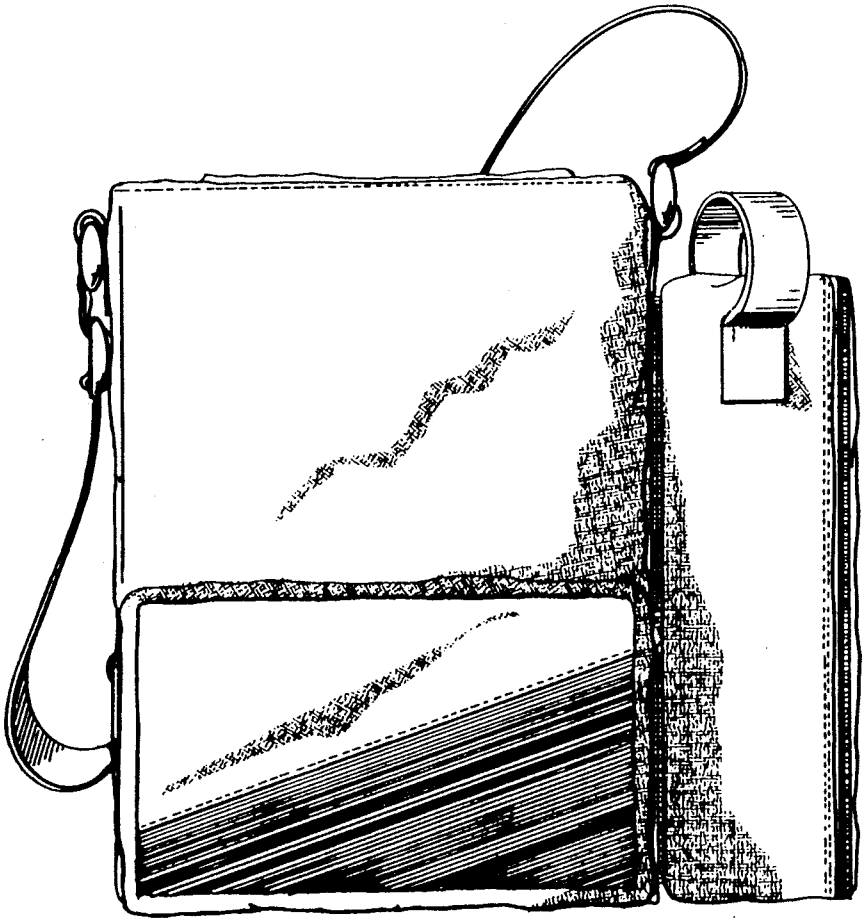
Figure 7:
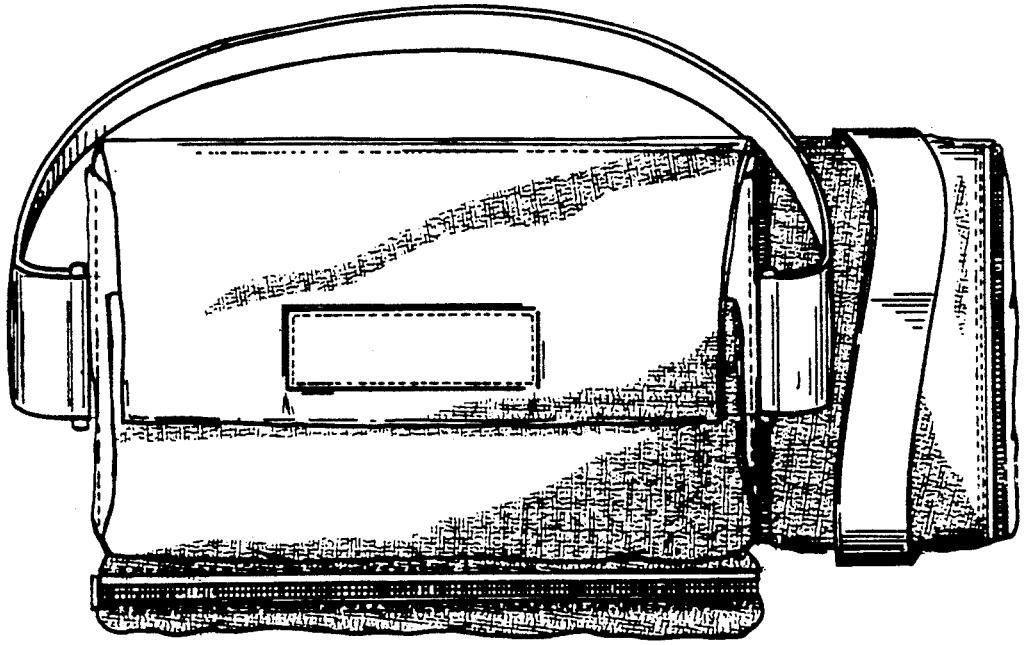
Figure 8:
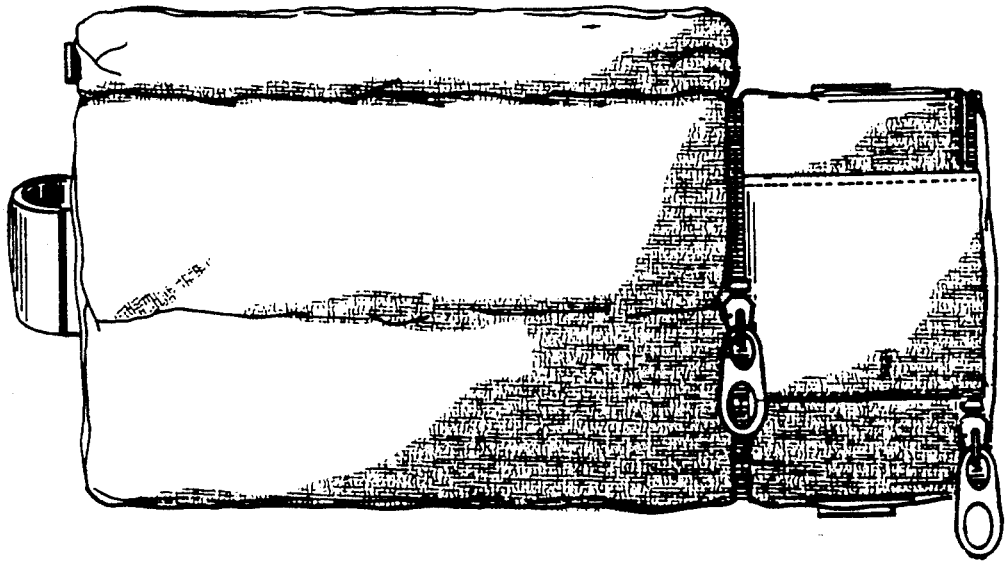
Figure 6:
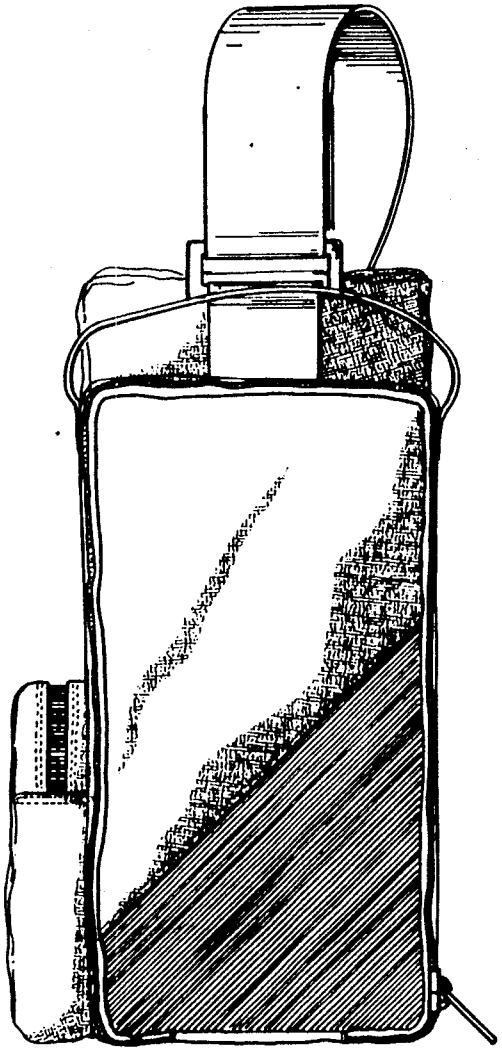

Referring to FIG. 2, insulated box 12 is formed from a base 21, four insulated walls 22', 24, 26, and 28 which have a waterproof inner surface below which is located an insulating foam (not shown). This foam is held in place by a webbed material, e.g., nylon. Each of the four walls are provided with flaps 30, 32, 34, and 36, also formed of webbed nylon. Flap 30 is provided with one half of a standard velcro material 37 adapted to mate with an opposite portion 39 of velcro material on flap 34 (shown by dashed lines in the FIG. 2) to allow the two flaps 30, 34 to be fixedly held together to close the insulated box, as shown in FIG. 1. Velcro material may be replaced with a zipper. Container 18 is formed from a webbed nylon extending from wall 26. A zipper 38 is provided in container 18 to allow opening and closing of the container.

Again referring to FIG. 2, storage case 14 is formed from a webbed material with a base 40 and four walls 42, 44, 46, and 48. The storage case is opened and closed by a flap 50 which pivots about one end 47 of wall 48 and is held against the other walls 42, 44, and 46 by a zipper 52. Positioned within case 14 is a plastic insert 51 having separators 53 for snugly holding individual audio tape boxes. Insert 51 helps to maintain the box like shape of case 14.

Figure 5:
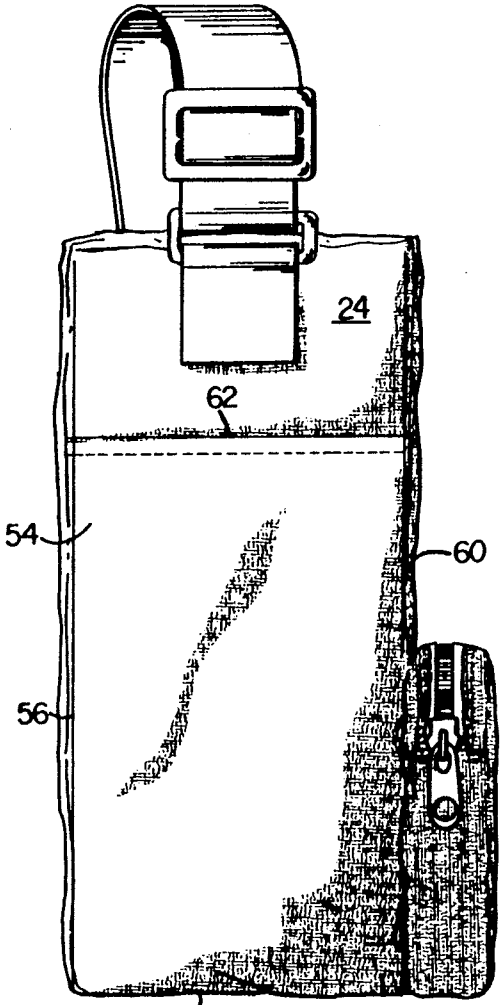

Referring to FIG. 5, wall 24 is provided with a pocket 54 formed from material which extends from wall 24, is fixed along three edges 56, 58, and 60, and has an open edge 62 to allow access to the pocket.

The above-described shoulder bag is formed from nylon by any standard procedure. Material for container 18 and pocket 54 is preferably sewed to the material of the insulated walls to provide a more secure structure.

Other embodiments are within the following claims.

I claim:

1. A bag for separately storing a plurality of electronic recording devices, and a plurality of liquid containers; comprising;

an insulated box, for storing the liquid containers, formed from a first base, four insulated walls, formed of insulating material having a waterproof inner surface, extending from and fixedly connected to said base, and a first flap, pivotally fixed to the end of one said insulated wall distant from said first base, said first flap in a first position adapted to provide access to said box for insertion and removal of the liquid containers, and in a second position adapted to prevent the liquid containers from falling from said box; and, fixed thereto, a storage case, for storing the electronic recording devices, formed from a second base, four walls extending from and fixedly connected to said second base, and a second flap pivotally fixed to one said wall distant from said second base, said second flap in a first position adapted to provide access to said box for insertion or removal of the electronic recording devices, and in a second position adapted to prevent the electronic recording devices from falling from said case; said case further including separators for separately snugly engaging the electronic recording devices and allowing their easy insertion and removal.

2. The bag of claim 1 wherein said insulated box and said storage case are removably fixed together.

3. The bag of claim 2 wherein said insulated box and said storage case are fixed together by a zipper.

4. The bag of claim 1 wherein said insulated box and said storage case each have a separate strap to allow separate holding of said box and said case.

5. The bag of claim 1 wherein said separators are formed as a separate insert within said case.

6. The bag of claim 1 wherein said second flap is provided with a zipper to allow holding of said flap in said second position.

7. The bag of claim 1 and further comprising a second flap adapted to mate with said first flap to hold the liquid containers within said box.

8. The bag of claim 1 further comprising a storage container formed from material extending from one said insulated wall and fixed to said one insulated wall, said material defining an opening to allow insertion and removal of a player for an electronic recording device.

9. The bag of claim 1, further comprising a pocket fixed to one said insulated wall, said pocket being formed from rectangular material fixed along only three edges to said one insulated wall.

* * * * *